United States Patent [19]

Kreisman

[11] 4,393,105

[45] Jul. 12, 1983

[54] METHOD OF FABRICATING A THERMAL PANE WINDOW AND PRODUCT

[75] Inventor: Wallace S. Kreisman, Malden, Mass.

[73] Assignee: Spire Corporation, Bedford, Mass.

[21] Appl. No.: 255,641

[22] Filed: Apr. 20, 1981

[51] Int. Cl.[3] ..... E06B 3/24

[52] U.S. Cl. ..... 428/34; 52/788; 52/790; 156/99; 156/104; 156/106; 428/192; 428/433

[58] Field of Search ..... 156/99, 101, 104, 106; 428/34, 107, 433, 122, 192; 52/788, 790

[56] References Cited

U.S. PATENT DOCUMENTS

| | | | |
|---|---|---|---|
| 2,398,371 | 4/1946 | Gerspacher | 428/34 |
| 2,618,819 | 11/1952 | Goodwille | 428/34 |
| 2,708,774 | 5/1955 | Seelen | 428/34 |
| 2,966,435 | 12/1960 | Kassinger | 428/34 |
| 3,183,560 | 5/1965 | Brichard | 428/34 |
| 3,397,278 | 8/1968 | Pomerantz | 156/272 |
| 3,417,459 | 12/1968 | Pomerantz | 156/272 |
| 3,544,294 | 12/1970 | Goto | 428/34 |
| 4,047,351 | 9/1977 | Derner | 428/34 |

FOREIGN PATENT DOCUMENTS 2726027 12/1978 Fed. Rep. of Germany .

*Primary Examiner*—Ellis P. Robinson

*Attorney, Agent, or Firm*—Morse, Altman & Dacey

[57] ABSTRACT

A method of fabricating a thermal pane window or door and the product so produced. The method comprises assembling at least two panes of glass in spaced parallel relation to each other, defining a space therebetween and separated all around the edges by a metal spacer frame, and electrostatically bonding the frame to its adjacent panes in the presence of heat and pressure.

The resultant thermal pane window or door is characterized by a hermetically sealed space between the two panes of glass that preferably has been evacuated so as to contain no moisture and oxygen and then preferably is filled with a low heat-loss gas or left under vacuum.

6 Claims, 5 Drawing Figures

METHOD OF FABRICATING A THERMAL PANE WINDOW AND PRODUCT

BACKGROUND OF THE INVENTION

1. Field of the Invention

The present invention relates generally to thermal pane windows and doors and, more particularly, to a method of fabricating a thermal pane window or door of improved characteristics and construction.

2. The Prior Art

Thermal pane windows and doors generally are made with two or more panes of glass, with air volumes sealed in between the panes to reduce the transfer of temperature. As known, air is a poor thermal heat conductor when compared with solid materials such as glass.

Most thermal pane windows and doors presently employ a plastic sealant, such as polysulfide, in order to seal off trapped air volumes between the glass panes. A desiccant, such as silica gel or a zeolite, is used to absorb moisture within the trapped air volumes. Over a period of time, the desiccant becomes saturated and moisture develops within the trapped air volumes between the glass panes. This moisture build up in between the glass panes occurs because the plastic sealant is permeable to gases, including water vapor. The moisture starts a process of corrosive reactions between the water vapor and its dissolved minerals and oxygen in contact with the glass panes and the plastic sealant. In addition, the condensation of water vapor between the glass panes adversely affects the visibility through the window.

SUMMARY OF THE INVENTION

It is a principal object of the present invention to overcome the above disadvantages by providing an improved thermal pane window and door that exhibits no corrosion and condensation characteristics despite prolonged use.

More specially, it is an object of the present invention to provide a method of fabricating a thermal pane window or door comprising assembling at least two panes of glass in parallel spaced relation to each other, defining a space therebetween and separated all around the edges by a metal spacer frame, heating the assembly preferably in a controlled environment, and hermetically sealing the metal spacer frame in place by electrostatic bonding by passing an electric current across the glass-metal-glass interfaces. Preferably, the controlled environment is either a vacuum or a low heat-transfer gas selected from the group including argon, krypton and Freon R-12. It is this controlled environment, devoid of moisture and oxygen, which is hermetically sealed in the space within the two panes of glass, preferably during the very process which seals the glass panes to the metal spacer frame. In the alterative, the method includes evacuating the space between the panes of glass of all moisture and air, specifically oxygen, and then either retaining the vacuum or filling the evacuated space with a low heat-transfer gas. Preferably, the glass is ordinary window glass and the metal spacer frame is formed of a soft ductile metal, such as aluminum and its alloys. Since neither the window glass nor the metal spacer frame is permeable to ordinary gases, the hermetically sealed space between the glass panes will reamin gas tight, hence devoid of corrosive degradation and condensation, during the entire useful life of the thermal pane window.

Other and further objects of the present invention will in part be obvious and will in part appear hereinafter.

The invention accordingly comprises the method of fabricating the thermal pane window or door of the present disclosure and the window or door so produced, the scope of which will be indicated in the appended claims.

BRIEF DESCRIPTION OF THE DRAWINGS

For a fuller understanding of the nature and objects of the present invention, reference is to be made to the following detailed description, which is to be taken in connection with the accompanying drawings, wherein.

DETAILED DESCRIPTION OF PREFERRED EMBODIMENTS

In general, the present invention relates to a method of fabricating thermal pane windows or doors of improved characteristics and construction. More specifically, the present invention relates to a method of fabricating thermal pane windows or doors employing electrostatic bonding techniques for hermetically sealing the space between the panes of glass. The sealed space preferably is evacuated of all moisture and oxygen and then either left under vacuum or else filled with a low heat-transfer gas. The resultant thermal pane window or door remains gas tight during its entire useful life and is not subject to corrosive degradation and condensation. Although the invention will be more particularly described with reference to windows, it is to be understood that the term "thermal pane window" as used in this specification and in the appended claims equally is intended to cover thermal pane doors as well.

Figure 1:
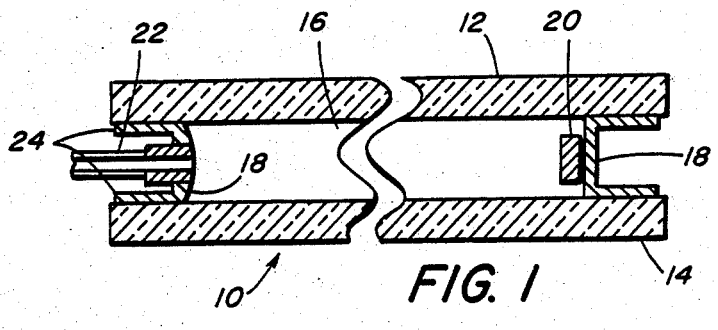
FIG. 1 is a cross section of a thermal pane window constructed according of the method of the present invention.
Figure 4:
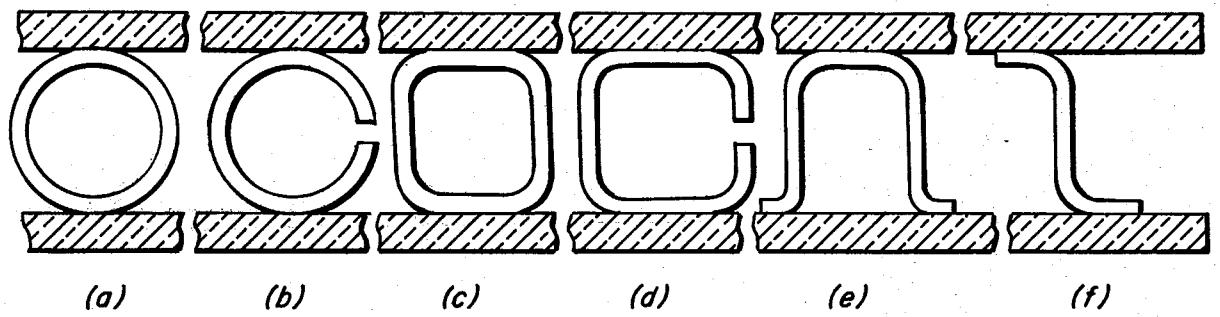
FIGS. 4(*a*)–(*f*) depict variations in the construction of a part of the thermal pane window shown in FIG. 1.

One preferred embodiment of a thermal pane window 10 is shown in cross section in FIG. 1. Thermal pane window 10 comprises top and bottom panes 12 and 14 of glass assembled in parallel spaced relation to one another so as to define a space 16 therebetween. The width of the space 16 is determined by the size of a metal spacer frame 18, introduced all around the four edges of the window 10. For ease of assembly, the metal spacer frame 18 is formed of four straight portions, with each portion being positioned between the two panes 12 and 14 at one edge thereof. The metal spacer frame 18 is either a strip bent, or roll formed or extruded channel that is shaped into one of a variety of preferred forms and preferably heliarc welded to form a single continuous part. One preferred form, a U-shaped rectangular form in right cross section, for the metal spacer frame 18 is illustrated in FIG. 1. Other preferred variations in the form and construction of the metal spacer frame 18 are depicted in FIGS. 4(*a*) through 4(*f*). FIG. 4(*a*) shows a tubular form and construction, FIG. 4(*b*) a split tubular form, FIG. 4(*c*) a rectangular form, FIG. 4(*d*) a split rectangular form, FIG. 4(*e*) a hat-shaped form, and FIG. 4(*f*) to Z-shaped form and contruction. Doubtless, several other shapes and forms will readily suggest themselves to those skilled to the thermal pane window and door making art. If and where desired for added structural strength for the window 10, a further support strip 20 of metal is secured, such as by welding, along the length of the spacer frame 18, substantially as shown in the right-hand side of FIG. 1.

One portion of the metal spacer frame 18 preferably is provided with an air-tight valve 22 communicating with the space 16 between the panes 12 and 14. This space 16 preferably is evacuated of all moisture and oxygen via this valve 22 during the window's 10 manufacture, as will be more fully described below. The evacuated space 16 is either sealed off under vacuum or thereafter filled via the valve 22 with a low heat-transfer gas selected from the group of argon, krypton and Freon R-12, and the valve 22 sealed off.

As mentioned, the method of the invention preferably employs electrostatic bonding (ESB) techniques for hermetically sealing the spacer 18 between the panes 12 and 14 of glass. As will be more fully described below, such hermetic seal by ESB is accomplished by passing an electric current across the glass-metal-glass interfaces 24 so as to bond the two abutting surfaces of the metal spacer frame 18 to the top and bottom panes 12 and 14 of glass, respectively.

ESB is a relatively new technology developed to bond an inorganic insulator element of normally high electrical resistivity, such as glass, to a metallic element, including semiconductors. See the U.S. Pat. No. 3,397,278 granted Aug. 13, 1968 to D. I. Pomerantz and the U.S. Pat. No. 3,417,459 granted Dec. 24, 1968 to D. I. Pomerantz et al., among others. As more thoroughly described in these patents, in order to effect an electrostatic bond between glass and a metal or a semiconductor, the substantially smooth and complemental adjoining surfaces of the two elements are placed in contact, the glass is then heated to generate ionic conductivity therein, and then a potential is applied across the elements, producing thereby an electric current through the elements. The interface region in the glass is depleted of positive ions, and negative ions (such as oxygen ions) in the glass move toward the metal. A strong electrostatic field is created in the narrow depletion region at the interface of the two elements which tends to pull the two surfaces together. The oxygen ions in the glass combine with the metal to form a strong chemical bond and a hermetic seal between the two elements.

Figure 2:
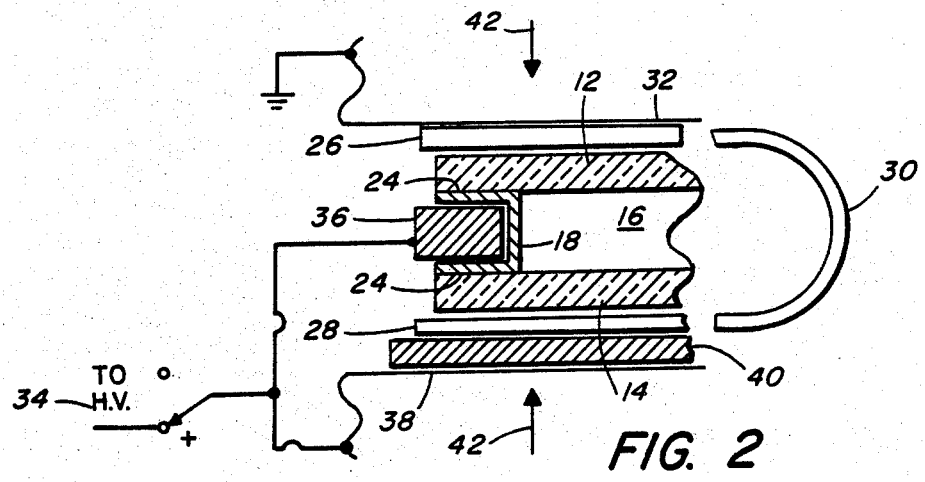
FIG. 2 is a schematic representation of one preferred method of fabricating the thermal pane window shown in FIG. 1.

One preferred method of fabricating the thermal pane window 10, employing the ESB technique, is illustrated schematically in FIG. 2. After the assembly of the top and bottom panes 12 and 14 of glass in parallel spaced relation to each other and separated by the metal spacer frame 18, the assembly is subjected to a heating operation. As mentioned, the panes 12 and 14 are preferably made of ordinary soda lime soft window glass and the metal spacer frame 18 of a soft ductile metal having a very low yield strength, such as aluminum or one of its alloys, e.g., a commercially pure, fully annealed aluminum alloy 1100-0. (By the term "yield strength," as used in this specification and the claims, it is intended to define that stress at which a material exhibits a specified deviation from proportionality of stress and strain.) Since the ESB technique requires that the glass and metal elements be exposed to heating and cooling, it is highly desirable that the two elements possess closely matched temperature coefficients of expansion. Practitioners for the most part have been solving this problem by developing special glasses and special metals with similar thermal expansion properties. The approach herein is different.

Commercially pure aluminum and some of its alloys in the fully annealed state possess low mechanical yield points. (The term "yield point," as used in this specification and the claims, is intended to define the lowest stress at which strain increases without increase in stress.) Such soft ductile metals can be pressed into intimate contact with ordinary Window glass as elevated temperatures at which an electrostatic bond is made despite the fact that the temperature coefficient of expansion of aluminum and its alloys is much greater than that of all the glasses, including the ordinary soda lime soft window glass used herein. After the bond is made at the elevated temperature and then allowed to cool down, the high stresses, that would otherwise occur in the glass as a result of thermal mismatch with the metal, nevertheless fail to develop here because the soft ductile metal used is stretched (or compressed) at a low stress level that is close to the yield stress. (The term "stress," as used in this specification and the claims, is intended to define the force acting across a unit area in a solid material in resisting the separation, compacting or sliding that tends to be induced by external forces. The term "yield stress," as used in this specification and the claims, is intended to define the lowest stress at which extension of the tensile test piece increases without increase in load.) Since the thickness of the metal spacer frame 18 is less than the thickness of the glass panes 12 and 14, the compressive stress (or tensile stress) developed in the glass panes 12 and 14 is smaller than the yield stress of the metal frame 18. The resultant compressive stress (or tensile stress) in the glass panes 12 and 14, therefore, is well within the strength capability of the glass so as to avoid any stress crack therein. (The term "stress crack," as used in this specification and in the claims, is intended to define an external or internal crack in a solid body caused by tensile, compressive or sheer forces.)

The heating operation to which the assembly of the panes 12 and 14 of glass, together with the metal spacer frame 18, is subjected to is represented by a minimum temperature of about 150° C. and no more than about 350° C. and for a time period of several minutes. Preferably, the heating operation is effected just prior to the electrostatic bonding of the glass-metal-glass interfaces 24, with both operations occurring substantially at the same time. To this end, the assembly is positioned within a top 26 and a bottom 28 electrode, preferably electrically joined to each other by a conductor 30 and maintained at ground potential such as via electrical contact to a grounded upper bonder plate 32. Electrical connection to a positive polarity high voltage 34 can be effected either directly to the metal spacer frame 18 or indirectly via a suitably shaped spacer electrode 36, introduced between the panes 12 and 14 of glass, as shown in FIG. 2. The spacer electrode 36 preferably serves a dual function. First, it allows for an excellent all around electrical connection to the metal spacer frame 18. Second, it also allows for lateral compressive pressure to be applied to the assembly, without the risk of deformation occurring in the frame 18, and insuring at the same time an intimate physical contact of the bonding surfaces at the glass-metal-glass interfaces 24. The positive polarity high voltage 34 may also be connected to the bottom bonder plate 38, which is insulated by an insulation plate 40 from the bottom electrode 28. The positive polarity high voltage 34 preferably is about 1,000 VDC, and generates an electric current across the glass-metal-glass interfaces 24 of about 2 milliamperes per $cm^2$. As mentioned, this current is passed through these interfaces 24 for several minutes, creating the electrostatic field required for the simultaneous electrostatic bonding of both interfaces 24. A hermetic seal is created thereby and in a single operation between the spacer frame 18 and the top and bottom panes 12 and 14 of glass all around the four edges of the thermal pane window 10. If desired, compressive pressure, as indicated by the arrows 42, also cn be applied to the assembly, simultaneously of its being heated and during the generation of the electrostatic field and the passage of the electrical current through the interfaces 24.

Following the hermetic bonding of the entire thermal pane window 10, preferably its interior space 16 between the panes 12 and 14 of glass is evacuated, via the air-tight valve 22, to a vacuum of about one torr or less. The evacuated space 16 then is left under vacuum or filled with a low heat-loss gas selected from the group including argon, krypton and Freon R-12 via the same valve 22, which is then sealed.

Rather than heating the entire thermal pane assembly and bonding around all four edges thereof in a single operation, the method can comprise bonding only a portion of the assembly at one time. The advantage here resides in that the entire assemly need not be heated uniformly. Care must be exercised, however, that the temperature gradient between the high temperature bonding region and the cooler parts of the glass panes 12 and 14 does not become so large as to cause thermal shock cracks in the panes 12 and 14. One such preferred method comprises roll bonding the assembly point-after-point by concurrently applying heat and pressure to one point at a time along the edges of the assembly, while simultaneously passing an electric current across the glass-metal-glass interfaces 24 at that point. Another such preferred method comprises line bonding the assembly along one edge of the assembly at one time, followed by line bonding the second, then the third and finally the fourth edge of the thermal pane assembly. In either of the above two bonding methods, the space 16 preferably is evacuated via the valve 22, followed by the space 16 being filled by a low heat-loss gas, such as argon, krypton or Freon R-12.

Figure 3:
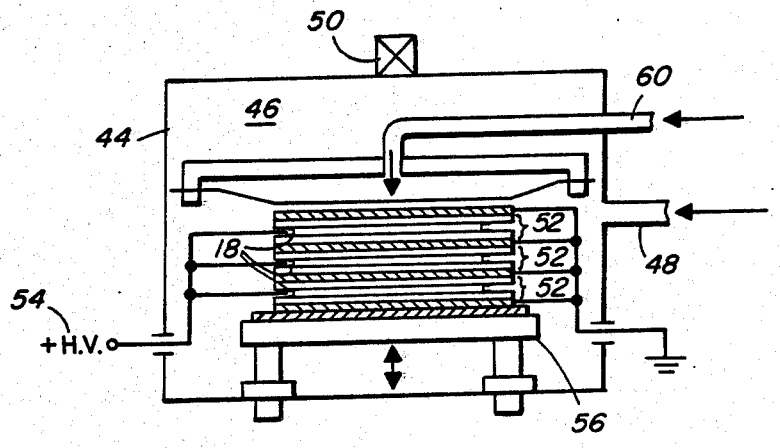
FIG. 3 is a schematic representation of another preferred method of fabricating the thermal pane window shown in FIG. 1.

A further preferred method of fabricating the thermal pane window 10 of FIG. 1 is schematically represented in FIG. 3. The salient feature of this method resides in that the ESB bonding is effected within a suitable housing 44 containing a controlled environment 46. This controlled environment 46 preferably comprises a vacuum or a low heat-loss gas, such as argon, krypton or Freon R-12 and continuously being admitted into the housing 44 via an opening 48. A valved connection 50 to the atmosphere for the housing 44 preferably is also provided to permit venting above a certain prescribed internal pressure.

One of the advantages in effecting the ESB bonding within the controlled environment 46 is that the gas therein is also used as the filling gas for the space 16 in between the glass panes 12 and 14. Another advantage resides in that this filling gas is introduced into and effectively trapped within the space 16 during the ESB bonding itself, obviating thereby the process steps of first having to evacuate the space 16 and then filling the evacuted space 16 with the gas via the valve 22. A further advantage of this method includes the possibility of bonding more than a single unit of a thermal pane assembly (i.e., the panes 12 and 14 of glass and the metal spacer frame 18 therebetween) at one time. A plurality of units 52 of thermal pane assemblies are stacked one on top of another, with grounded electrodes in between each unit. Positive high voltage is applied to each metal spacer frame 18 (or to spacer electrodes 36 inserted into the frames 18) from a single, high voltage and high current power supply 54. The units 52 preferably are stacked on a table 56, whose height within the housing 44 is adjustable. This adjustability in height of the table 56 permits the stack of units 52 to be raised until the stack bears against a flexible diaphragm 58. This flexible diaphragm 58 then is used to apply pressure to the stack by admitting another gas, such as air, under pressure against the upper side of the diaphragm 58 via a suitable hose 60. Consequently, a plurality of units 52 of thermal pane assemblies are bonded simultaneously in one simplified operation in which the controlled environment gas or vacuum 46 is used also as the thermal pane filling gas for the space 16 in between the panes 12 and 14.

Figure 5:
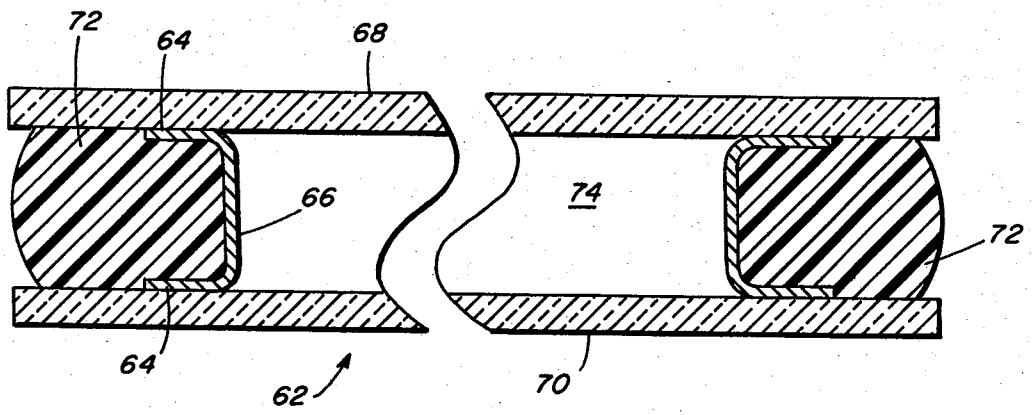
FIG. 5 is a cross section of another embodiment of a thermal pane window constructed according to the method of the present invention.

A still further embodiment of a thermal pane window 62 is shown in FIG. 5. In this embodiment, the ESB technique is applied to achieve hermetic electrostatically sealed interfaces 64 between a relatively thin metal spacer frame 66 and panes of glass 68 and 70. Following the ESB bonding operation, which preferably employs a spacer electrode 36 like the one disclosed in FIG. 2, a plastic material 72 is added in the area outside the frame 66 and previously occupied by the spacer electrode. The plastic material 72 provides additional mechanical structural strength and rigidity to the thermal pane window 62 so produced, but is not responsible for also providing the hermetic seal thereto. A vacuum or a low heat-transfer gas, such as argon, krypton or Freon R-12 again either is trapped in a space 74 between the glass panes 68 and 70 during the ESB process itself or is introduced therein via an air-tight valve, such as 22 in FIG. 1, following the evacuation of the space 74.

Thus it has been shown and described a method of fabricating thermal pane windows of improved characteristics and construction, which method and resultant product satisfy the objects and advantages set forth above.

Since certain changes may be made in the present disclosure without departing from the scope of the present invention, it is intended that all matter described in the foregoing specification or shown in the accompanying drawings, be interpreted in an illustrative and not in a limiting sense.

What is claimed is:

1. A method of fabricating a thermal pane window comprising:

(a) providing an assembly of at least two panes of glass in spaced parallel relation to each other so as to define a space therebetween and separated all around the edges by a metal spacer frame;

(b) inserting a spacer electrode within said metal spacer frame;

(c) roll bonding said assembly all around said edges by concurrently applying heat and pressure to one point at a time along said edges while passing an electric current across the glass-metal, glass interfaces at said one point, said pressure being applied to said one point being about 1000 p.s.i., said roll bonding said assembly hermetically sealing said space between said panes of glass;

(d) evacuating said hermetically sealed space to about one torr or less; and (e) sealing off said evacuated space.

2. The method of claim 1 further including filling said evacuated space with a low heat-loss gas selected from the group including argon, krypton and Freon R-12.

3. A method of fabricating a thermal pane window comprising:

(a) providing an assembly of at least two panes of glass in spaced parallel relations to each other so as to define a space therebetween and separated all around the edges by a metal spacer frame;

(b) inserting a spacer electrode within said metal spacer frame;

(c) heating along one edge of said assembly at a time while subjecting said edge to pressure;

(d) electrostatically bonding said edge by passing an electric current across the glass-metal-glass interfaces, said electrostatic bonding being effected by said electric current for about one minute, said pressure being applied along said edge being about 1000 p.s.i., and said current being propelled by a potential of about 1,000 VDC;

(e) removing said spacer electrode from within said metal spacer frame; and (f) introducing a plastic sealant into the space occupied by said spacer electrode.

4. A method of fabricating a thermal pane window comprising:

(a) providing an assembly of at least two panes of glass in spaced parallel relation to each other so as to define a space therebetween and separated at the edges by a metal spacer frame, said glass being a soda lime soft window glass and said metal spacer frame being formed of a soft ductile metal having a low yield strength, said soft ductile metal being provided with a supporting strip of metal substantially along the length of said metal spacer frame;

(b) inserting a spacer electrode within said metal spacer frame;

(c) introducing said assembly, with said spacer electrode, into a housing containing a controlled environment, said controlled environment being a low heat-loss gas selected from the group of argon, krypton, and Freon R-12;

(d) heating said assembly while subjecting it to compressive pressure; and (e) electrostatically bonding said metal spacer frame to its said adjacent panes, whereby said controlled environment is hermetically sealed in said space between said panes.

5. A method of fabricating an improved thermal pane window comprising:

(a) assembling of plurality of panes of glass in spaced parallel relation to each other, defining a space between adjacent panes to form a unit, by positioning a number of metal spacer frames having channels communicating with said spaces, between adjacent panes all around their edges;

(b) inserting a numer of metal spacer electrodes within said metal spacer frames;

(c) introducing said assembly comprising a plurality of said units, with said spacer electrodes, into a housing provided with a flexible diaphragm and containing a controlled environment, said controlled environment being a low heat-loss gas selected from the group of argon, krypton, and Freon R-21;

(d) heating said assembly of said plurality of said units to a temperature not exceeding about 350° C. while subjecting it to compressive pressure via said flexible diaphragm; and (e) applying a hight voltage potential of about 1,000 VDC across said assembly so as to hermetically bond all of said units simultaneously, whereby each of said spaced between adjacent panes forming each of said plurality of units is filled during said fabricating with said controlled environment, said controlled environment being hermetically sealed in said space in a single operation during said hermetically bonding by electrostatic bonding, said metal spacer frame in place all around said edges of said panes of glass.

6. A thermal pane window exhibiting no corrosion and condensation characteristics despite prolonged use comprising:

(a) at least two panes of glass in parallel spaced relation to one another and separated by a thin metal spacer frame said spaces offset from the edges of said panes of glass along opposed interfaces formed between said spacer frame and said panes of glass, said spacer frame being electrostatically sealed to said panes of glass along said opposed interfaces hermetically sealing the space between said panes, said metal spacer frame being formed of aluminum alloy, and a plastic material disposed in and occupying the space between said panes of glass outwardly of said thin metal spacer frame toward the edges of said panes of glass, said plastic material provides structural strength and rigidity to said thermal pane window; and (b) a low heat-transfer gas devoid of oxygen and moisture contained within said space, said low heat-transfer gas being selected from the group including argon, krypton, and Freon R-12.

* * * * *